US007641090B2

(12) United States Patent
Ho

(10) Patent No.: US 7,641,090 B2
(45) Date of Patent: Jan. 5, 2010

(54) QUICK-RELEASABLE NAIL OUTPUT NOZZLE FOR NAIL GUN

(75) Inventor: Kuo-Hsiung Ho, Taichung County (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 295 days.

(21) Appl. No.: 11/797,788

(22) Filed: May 8, 2007

(65) Prior Publication Data

US 2008/0277298 A1 Nov. 13, 2008

(51) Int. Cl.
*B25C 5/02* (2006.01)

(52) U.S. Cl. ..... 227/123; 227/8; 227/29; 227/30; 227/109; 227/127

(58) Field of Classification Search ..... 227/8, 227/123, 29, 30, 109, 127, 110
See application file for complete search history.

(56) References Cited

U.S. PATENT DOCUMENTS 3,858,780 A * 1/1975 Perkins et al. ..... 227/8
4,200,215 A * 4/1980 Novak et al. ..... 227/123
4,323,127 A * 4/1982 Cunningham ..... 173/53
4,346,831 A * 8/1982 Haytayan ..... 227/8
4,389,012 A * 6/1983 Grikis et al. ..... 227/120
4,641,772 A * 2/1987 Skuthan ..... 227/123
5,884,829 A * 3/1999 Wingert ..... 227/151
5,931,364 A * 8/1999 Dennis ..... 227/109
6,082,604 A * 7/2000 Dennis ..... 227/8
6,763,989 B2 * 7/2004 Wang ..... 227/123
7,213,732 B2 * 5/2007 Schell et al. ..... 227/8
2003/0042285 A1 * 3/2003 Wang ..... 227/123
2003/0062394 A1 * 4/2003 Wang ..... 227/123
2005/0218175 A1 * 10/2005 Schell et al. ..... 227/8
2005/0218176 A1 * 10/2005 Schell et al. ..... 227/8
2006/0249554 A1 * 11/2006 Butzen et al. ..... 227/130

* cited by examiner

*Primary Examiner*—Brian D Nash
(74) *Attorney, Agent, or Firm*—Bacon & Thomas, PLLC

(57) ABSTRACT

A quick-releasable nail output nozzle for a nail gun includes a nozzle base, which is affixed to a nail outlet port of a nail magazine and has a nail output groove on the front side for guiding out a bar of nails, two side wings, and two hooks spaced below the side wings. A nozzle cover is covered on the front side of the nozzle base and has two flanges with protruding blocks respectively hooked on the back side of the side wings of the nozzle base. A locking lever is pivoted to the nozzle cover. A hook rod is pivoted to the locking lever for hooking up with the hooks of the nozzle base by means of the control of the locking lever.

2 Claims, 6 Drawing Sheets

QUICK-RELEASABLE NAIL OUTPUT NOZZLE FOR NAIL GUN

BACKGROUND OF THE INVENTION

1. Field of the Invention

The present invention relates generally to a nail gun and more specifically, to a nail output nozzle mounting to a nail outlet port of the nail gun. The nail output nozzle has its parts quick-releasably disassembled.

2. Description of the Related Art

During the nailing operation of a nail gun, nails may be jammed in the nail outlet port of the nail magazine. Therefore, the nail output nozzle of a regular nail gun is made detachable. By means of a quick-release design, the nail output nozzle is quickly detachable for clearing a nail jam.

FIG. 1 illustrates a quick-releasable nail output nozzle for a nail gun according to the prior art. As illustrated, the nail output nozzle comprises a nozzle base 2 and a nozzle cover 3. The nozzle base 2 is fixedly fastened to a nail outlet port of a nail magazine 1, having a nail output groove (not shown) longitudinally formed on the front side for guiding out a bar of nails. The nozzle cover 3 is fastened to the nozzle base 2 by means of swivel hook 4. When fastened up the swivel hook 4, the nozzle cover 3 is secured to the nozzle base 2.

Because the nozzle cover 3 is clamped on the nozzle base 2, it is prohibited from horizontal displacement (in FIG. 1). However, this design has no means to prohibit the nozzle cover 3 from vertical displacement (in FIG. 1) relative to the nozzle base 2. During a nailing operation, the nozzle cover 3 may be vibrated and forced away from the nozzle base 2, causing accidental injury.

SUMMARY OF THE INVENTION

The present invention has been accomplished under the circumstances in view. It is one objective of the present invention to provide a quick-releasable nail output nozzle for a nail gun, which provides an excellent locking effect, preventing displacement of the parts.

To achieve this objective of the present invention, the quick-releasable nail output nozzle comprises a nozzle base for fixedly fastening to a nail outlet port of a nail magazine. The nozzle base has a nail output groove longitudinally formed on a front side thereof for guiding out a bar of nails, two side wings respectively symmetrically extending from two opposite lateral sides thereof, and two hooks forwardly extending from the front side and symmetrically disposed at two opposite lateral sides relative to the nail output groove. A nozzle cover is covered on the front side of the nozzle base. The nozzle cover has two lugs perpendicularly forwardly extending from two opposite lateral sides thereof, two flanges respectively extending from the two opposite lateral sides and respectively engaged with the side wings of the nozzle base, and two protruding blocks respectively formed on the flanges and respectively stopped at a back side of the side wings of the nozzle base. A release control unit for locking the nozzle cover to the nozzle base includes a hook rod hookable up with the hooks of the nozzle base and a locking lever pivoted to the lugs of the nozzle cover for locking the hook rod to the hooks of the nozzle base. The locking lever has two first through holes bilaterally aligned with each other. The hook rod has two distal ends respectively pivotally hooked in the first through holes of the locking lever.

When the nozzle cover is locked to the nozzle base, the hook rod is hooked up with the hooks of the nozzle base to prohibit displacement of the nozzle cover relative to the nozzle base in a first direction; the flanges of the nozzle cover are stopped against the side wings of the nozzle base to prohibit displacement of the nozzle cover relative to the nozzle base in a second direction reversed to the first direction; the nozzle cover is closely attached to the front side of the nozzle base and stopped by the nozzle base from movement relative to the nozzle base in a third direction that is perpendicular to the first direction; and the protruding blocks of the nozzle cover are stopped at the back sides of the side wings to prohibit displacement of the nozzle cover relative to the nozzle base in a fourth direction reversed to the third direction. Therefore, the nozzle cover is firmly and detachably locked to the nozzle base.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
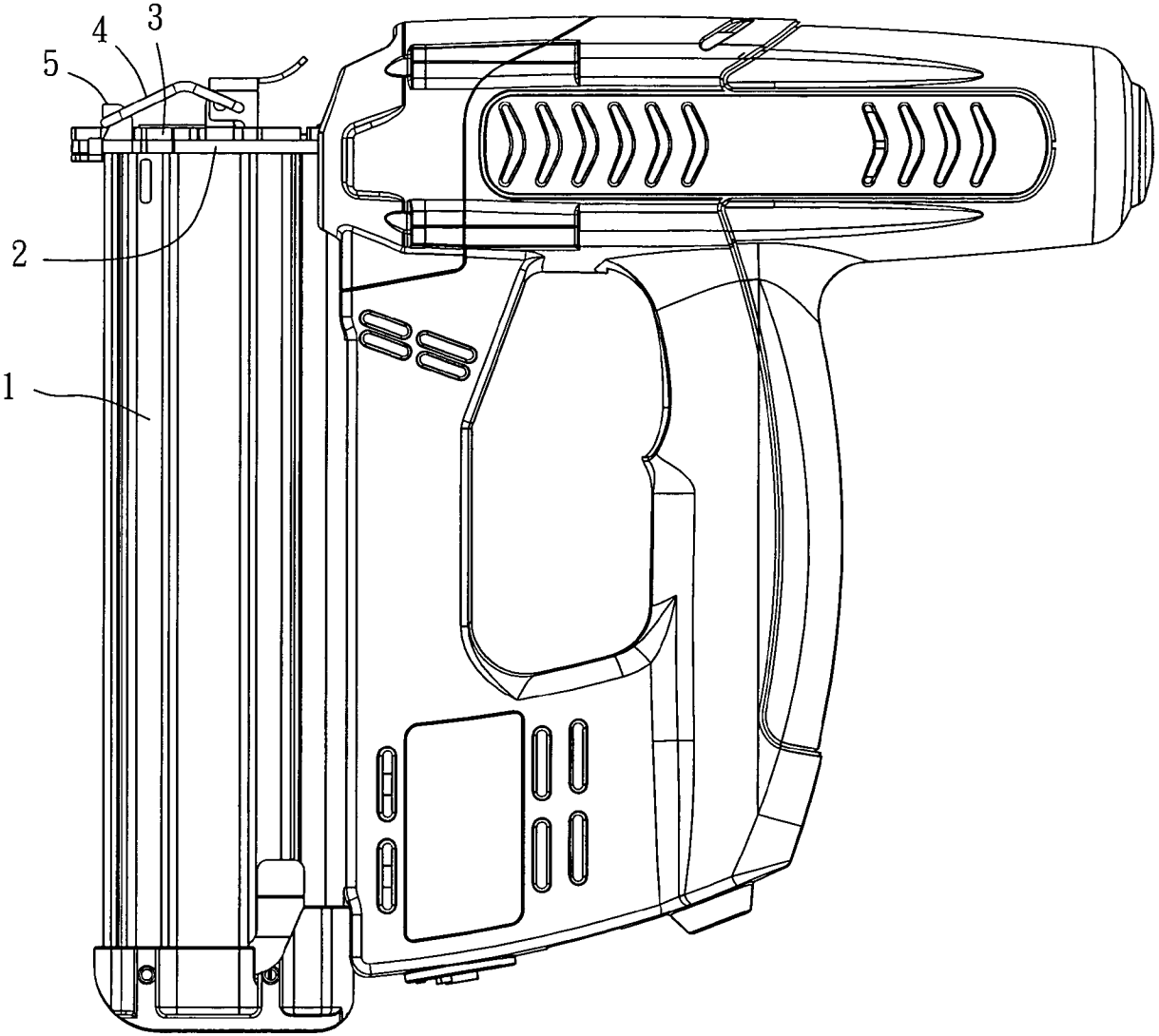
FIG. 1 PRIOR ART
FIG. 1 is a respective view of a prior art nail gun.
Figure 2:
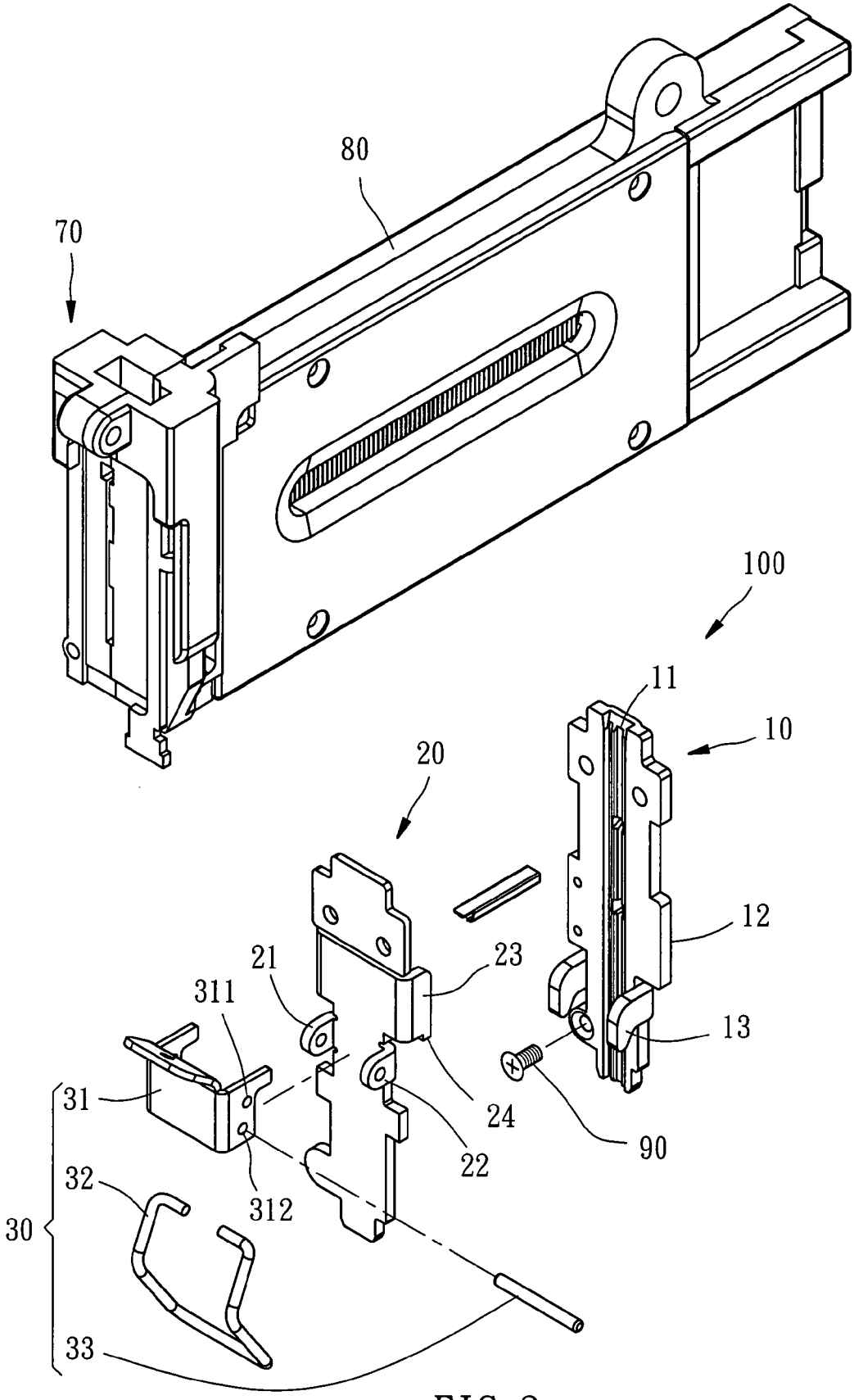
FIG. 2 is an exploded view of a quick-releasable nail output nozzle for a nail gun according to a preferred embodiment of the present invention and a nail magazine to be coupled to the nail output nozzle.
Figure 3:
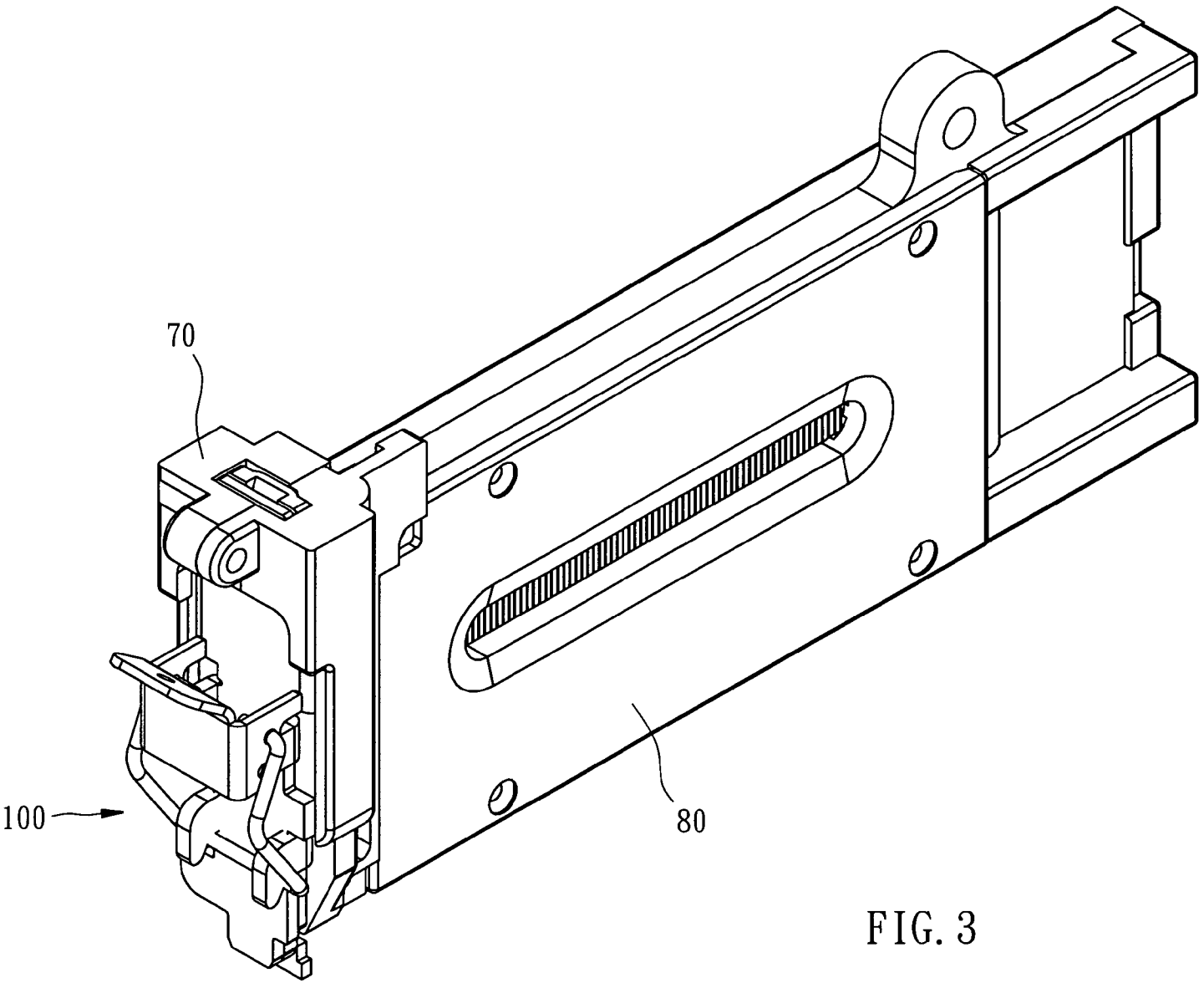
FIG. 3 is a perspective assembly view of FIG. 2.
Figure 4:
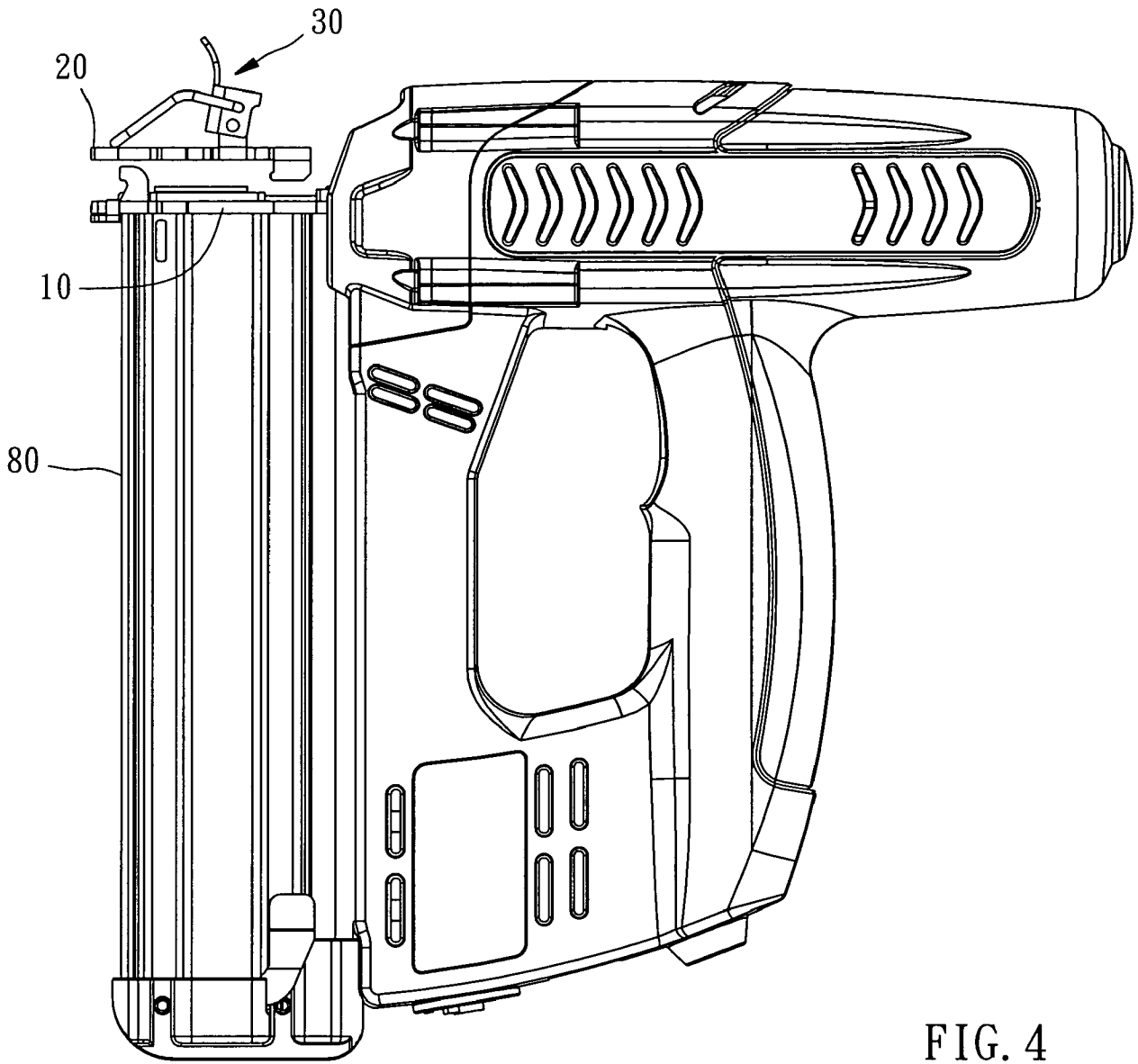
FIG. 4 is a schematic drawing showing the installation of the nozzle cover to the nozzle base of the present invention.
Figure 5:
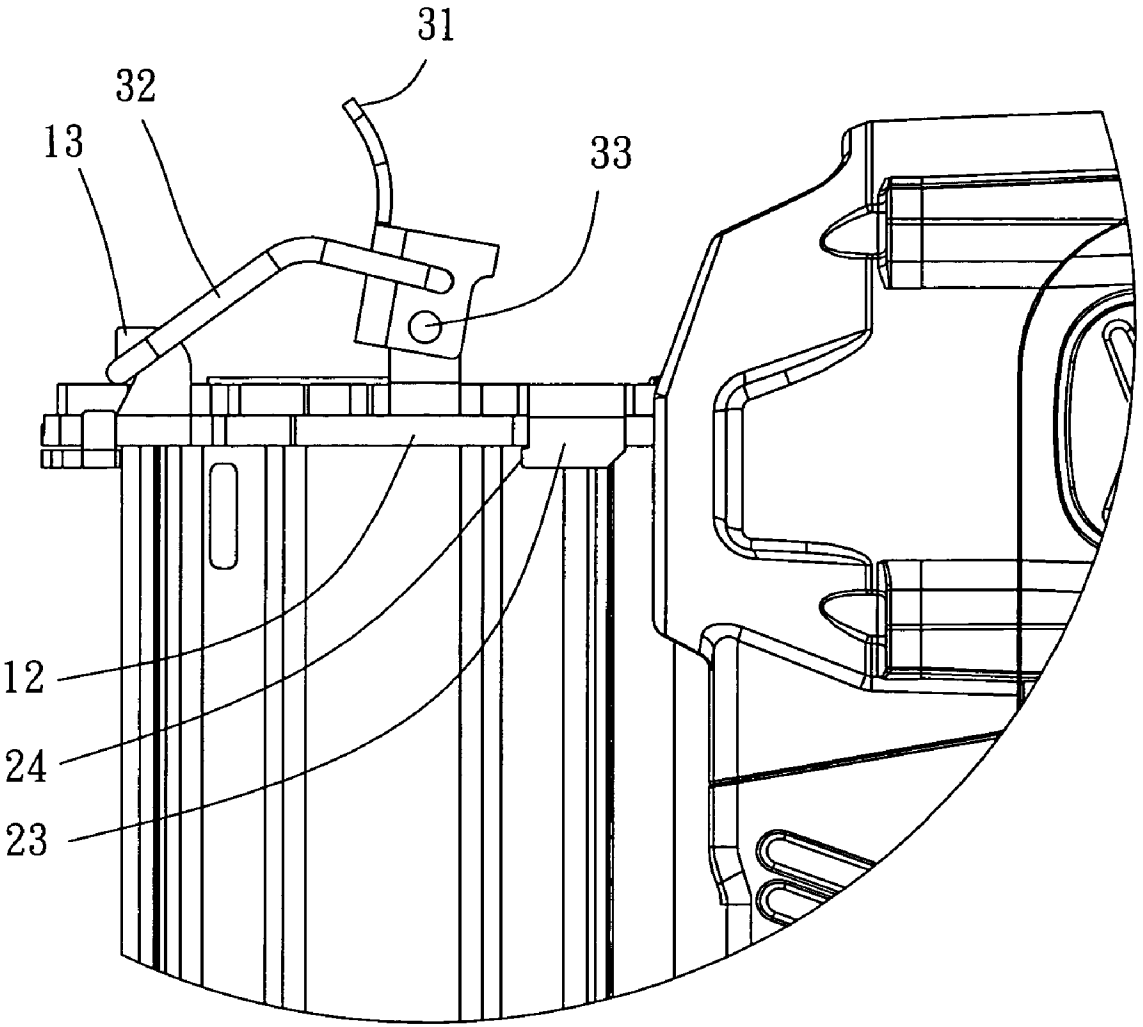
FIG. 5 is a schematic drawing showing the nozzle cover is hooked on the nozzle base of the present invention.

As shown in FIGS. 2-6, a quick-releasable nail output nozzle 100 in accordance with a preferred embodiment of the present invention comprises a nozzle base 10, a nozzle cover 20, and a release control unit 30.

The nozzle base 10 is attached with its back side to the nail outlet port 70 of a nail magazine 80 and affixed thereto with screws 90, having a nail output groove 11 longitudinally formed on its front side for guiding out a bar of nails, two side wings 12 symmetrically extending from its two opposite lateral sides, and two hooks 13 forwardly extending from its front side and symmetrically disposed at two opposite lateral sides of the nail output groove 11.

The nozzle cover 20 is covered on the front side of the nozzle base 10, having two lugs 21 perpendicularly forwardly extending from two opposite lateral sides thereof, two flanges 23 respectively outwardly extending from the two opposite lateral sides thereof above the elevation of the lugs 21 and then respectively turned backwards in direction reversed to the lugs 21, and two protruding blocks 24 respectively protruding from the flanges 23 at the bottom side. The lugs 21 each have a through hole 22.

The release control unit 30 includes a locking lever 31, a hook rod 32, and a pivot pin 33. The locking lever 31 has two first through holes 311 and two second through holes 312 bilaterally symmetrically arranged at different elevations. The hook rod 32 has two distal ends respectively pivotally hooked in the first through holes 311 of the locking lever 31. The pivot pin 33 is inserted through the second through holes 312 of the locking lever 31 and the through holes 22 of the lugs 21 of the nozzle cover 20 to pivotally secure the locking lever 31 to the nozzle cover 20.

After understanding of the composition and configuration of the component parts of quick-releasable nail output nozzle 100, the operation and features of the present invention will be described hereinafter.

After fixation of the nozzle base 10 to the nail outlet port 70 of a nail magazine 80, the nozzle cover 20 is fastened to the nozzle base 10 (see FIG. 4) by: attaching the nozzle cover 20 to the front side of the nozzle base 10 to have the flanges 23 be set at two opposite lateral sides of the nozzle base 10, and then loosing the locking lever 31 (turning the locking lever 31 upwards to the unlocking position) for enabling the hook rod 32 to be hooked on the hooks 13 of the nozzle base 10 (see FIG. 5), and then tightening the locking lever 31 (turning the locking lever 31 downwards to the locking position) to lock the hook rod 32 to the hooks 13 of the nozzle base 10. When turning the locking lever 31 downwards from the unlocking position to the locking position, the nozzle cover 20 is moved relative to the nozzle base 10 to force the flanges 23 toward the side wings 12, thereby holding the protruding blocks 24 into positive engagement with the back walls of the side wings 12 (see FIG. 6), and therefore the nozzle cover 20 is locked to the nozzle base 10.

Figure 6:
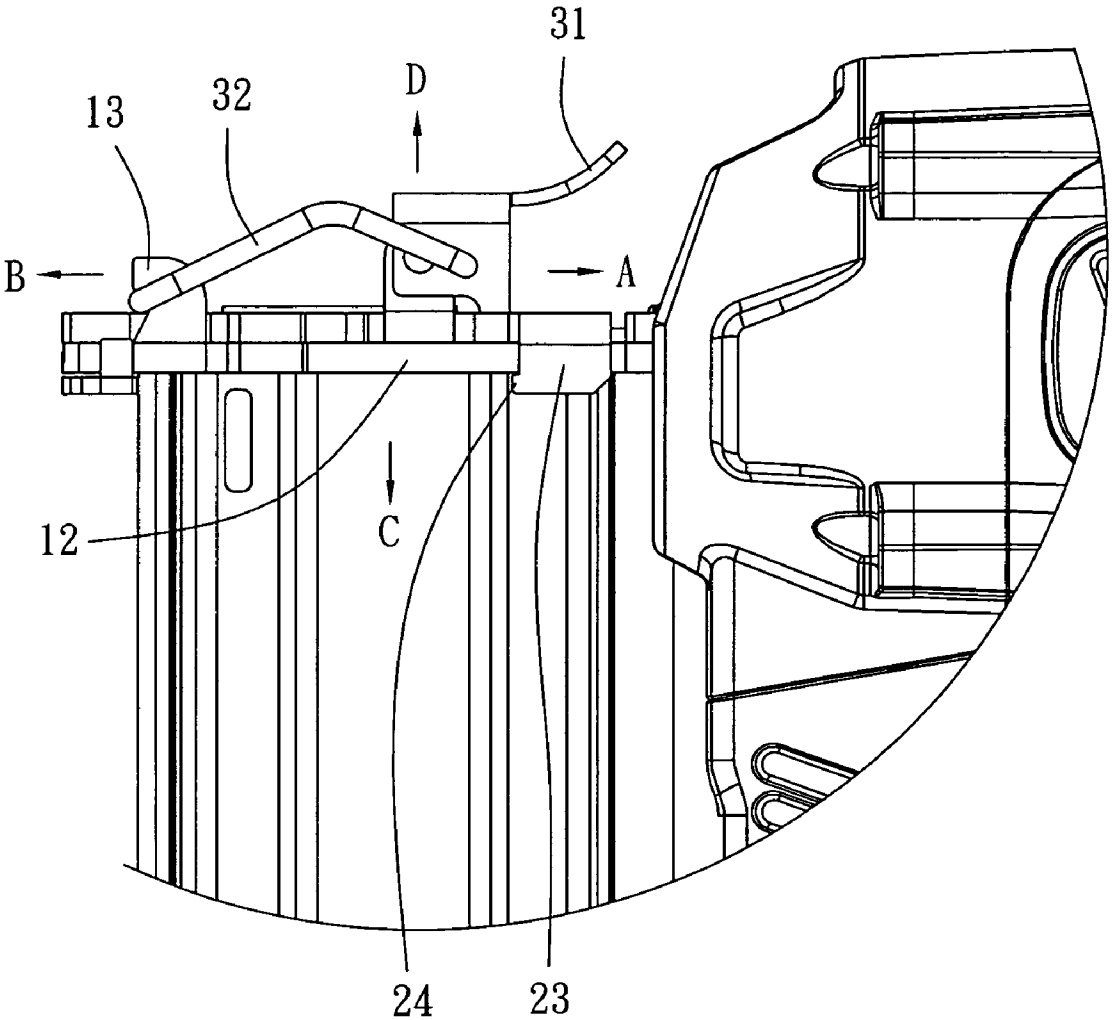
FIG. 6 is a schematic drawing showing the nozzle cover is completely locked to the nozzle base of the present invention.

After installation as shown in FIG. 6, the hook rod 32 is hooked up with the hooks 13 of the nozzle base 10 to prohibit displacement of the nozzle cover 20 relative to the nozzle base 10 in a first direction A, the flanges 23 are stopped against the respective side wings 12 to prohibit displacement of the nozzle cover 20 relative to the nozzle base 10 in a second direction B (the second direction B is reversed to the first direction A), the nozzle cover 20 is closely attached to the front side of the nozzle base 10 and stopped by the nozzle base 10 from movement relative to the nozzle base 10 in a third direction C (the third direction C is perpendicular to the first direction A), and protruding blocks 24 are stopped at the back walls of the respective side wings 12 to prohibit displacement of the nozzle cover 20 relative to the nozzle base 10 in a fourth direction D (the fourth direction D is reversed to the third direction C). Therefore, the nozzle cover 20 is firmly locked to the nozzle base 10.

A particular embodiment of quick-releasable nail output nozzle for a nail gun has been constructed with the features of FIGS. 2-6. The quick-releasable nail output nozzle for a nail gun functions smoothly to provide all of the features discussed earlier.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A quick-releasable nail output nozzle comprising:

a nozzle base for fixedly fastening to a nail outlet port of a nail magazine, said nozzle base having a nail output groove longitudinally formed on a front side thereof for guiding out a bar of nails, two side wings respectively symmetrically extending from two opposite lateral sides thereof, and two hooks forwardly extending from the front side and symmetrically disposed at two opposite lateral sides relative to said nail output groove;

a nozzle cover covered on the front side of said nozzle base, said nozzle cover having two lugs perpendicularly forwardly extending from two opposite lateral sides thereof, two flanges respectively extending from the two opposite lateral sides and respectively engaged with the side wings of said nozzle base, and two protruding blocks respectively formed on said flanges and respectively stopped at a back side of said side wings of said nozzle base; and a release control unit having a hook rod hookable up with the hooks of said nozzle base and a locking lever pivoted to said nozzle cover for locking said hook rod to the hooks of said nozzle base, said locking lever having two first through holes bilaterally aligned with each other, said hook rod having two distal ends respectively pivotally hooked in the first through holes of said locking lever, wherein said hook rod is hooked up with the hooks of said nozzle base to prohibit displacement of said nozzle cover relative to said nozzle base in a first direction; said flanges of said nozzle cover are stopped against said side wings of said nozzle base to prohibit displacement of said nozzle cover relative to said nozzle base in a second direction reversed to said first direction; said nozzle cover is closely attached to the front side of said nozzle base and stopped by said nozzle base from movement relative to said nozzle base in a third direction that is perpendicular to said first direction; the protruding blocks of said nozzle cover are stopped at the back sides of said side wings to prohibit displacement of said nozzle cover relative to said nozzle base in a fourth direction reversed to said third direction.

2. The quick-releasable nail output nozzle as claimed in claim 1, wherein said lugs of said nozzle cover each have a through hole and said locking lever of said release control unit has two second through holes bilaterally aligned with the through holes of said lugs of said nozzle cover; wherein said release control unit further comprises a pivot pin inserted through said second through holes of said locking lever and the through holes of said lugs of said nozzle cover to pivotally secure said locking lever to said nozzle cover.

* * * * *